United States Patent [19]

Söderberg

[11] Patent Number: 5,033,979

[45] Date of Patent: Jul. 23, 1991

[54] CONNECTING DEVICE FOR COAXIAL CONDUCTORS

[75] Inventor: Håkan Söderberg, Tumba, Sweden

[73] Assignee: Telefonaktiebolaget LM Ericsson, Stockholm, Sweden

[21] Appl. No.: 537,646

[22] Filed: Jun. 14, 1990

[30] Foreign Application Priority Data

Jun. 28, 1989 [SE] Sweden ..... 8902343

[51] Int. Cl.[5] ..... H01R 9/05

[52] U.S. Cl. ..... 439/578; 439/874

[58] Field of Search ..... 439/578, 579, 580, 581, 439/582, 584, 585, 874, 876, 607, 610

[56] References Cited

U.S. PATENT DOCUMENTS

| | | | |
|---|---|---|---|
| 3,828,305 | 6/1974 | Hogendobler | 439/585 |
| 4,014,601 | 3/1977 | Pittman | 439/876 |
| 4,169,650 | 10/1979 | Schweizer | 439/610 |

FOREIGN PATENT DOCUMENTS

| | | | |
|---|---|---|---|
| 2543421 | 4/1976 | Fed. Rep. of Germany | 439/876 |
| 7413113 | 4/1976 | Netherlands | 439/876 |
| 428164 | 6/1983 | Sweden . | |
| 2025161 | 1/1980 | United Kingdom . | |
| 2187898 | 9/1987 | United Kingdom . | |

OTHER PUBLICATIONS

J. P. Parete, "Circuit and Wire Lead Welder", vol. 2, No. 2, Aug. 1959.

Stanley J. Bieda, "Soldered Connections", Nov. 1954, pp. 115 and 116.

*Primary Examiner*—Larry I. Schwartz

*Assistant Examiner*—Hen D. Vu

*Attorney, Agent, or Firm*—Burns, Doane, Swecker & Mathis

[57] ABSTRACT

The present invention relates to a connecting device for coaxial conductors, comprising a terminal strip incorporated in a multipolar contact device. According to the invention, one end of a connecting member (6) has the form of a sleeve (9) which is firmly pressed into electrically-conducting contact with an exposed outer end of the screen (10) of the coaxial conductor (5). The other end of the connecting member (6) has the form of a flat, square plate (11) having provided in the corners thereof holes (12) for electrical contact with corresponding pins (3) in the terminal strip (2) and with a free opening (13) located centrally in relation to the holes (12) and encircling a corresponding, centrally located pin (4) in the terminal strip (2). The central conductor (14) of the coaxial conductor (5) is soldered or wired to the central pin (4).

5 Claims, 1 Drawing Sheet

CONNECTING DEVICE FOR COAXIAL CONDUCTORS

TECHNICAL FIELD

The present invention relates to a connecting device for coaxial conductors, comprising a terminal strip incorporated in a multipolar contact device.

BACKGROUND ART

A connecting device for coaxial conductors is known from SE-B-8106104-6. In the case of this known connecting device, the screening sleeve of a coaxial conductor is inserted between four pins in the terminal strip of the connecting device, and the central conductor of the coaxial conductor is soldered to a pin located centrally in relation to said four pins. The screening sleeve is provided with longitudinally extending slots which are somewhat shorter than the pins, so that when the screening sleeve is inserted between the pins, said pins engage with the slots and elastically retain the sleeve. The sleeve may also be soldered to the pins, so as to improve sleeve-retention.

The drawback with this known connecting device is that it lacks the possibility of running tests under traffic conditions, i.e. when the connecting device is connected to a corresponding contact device in, for instance, telecommunication equipment.

DISCLOSURE OF THE INVENTION

The object of the present invention is to provide a connecting device for coaxial conductors which will enable tests to be run during traffic, i.e. when the connecting device is connected to associated equipment. This object is achieved with a connecting device having the characteristic features set forth in the accompanying claims.

The invention will now be described in more detail with reference to an exemplifying embodiment thereof illustrated in the accompanying drawing.

BEST MODES OF CARRYING OUT THE INVENTION

Figure 1:
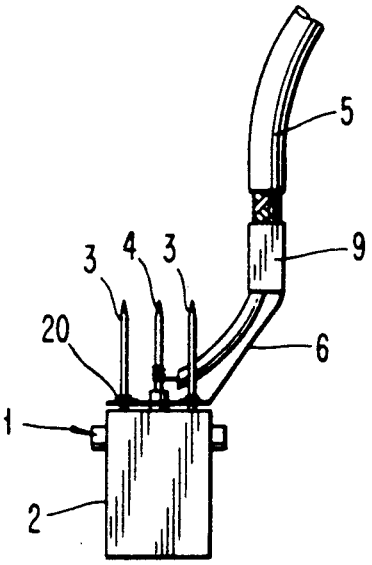
FIG. 1 is a side view of an inventive connecting device.
Figure 2:
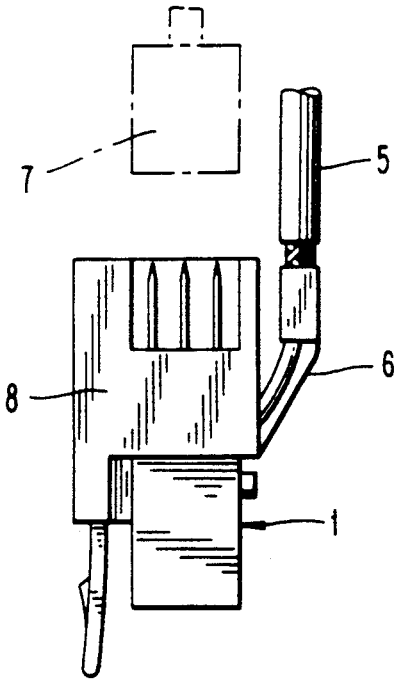
FIG. 2 illustrates the connecting device provided with a casing, and also shows the possibilities of carrying-out tests with a testing device shown in broken lines.

FIG. 1 illustrates an inventive connecting device 1 from one side thereof. The connecting device 1 includes a terminal strip 2 incorporated in a multipolar contact device and intended to be plugged into a corresponding multipolar contact device. The terminal strip 2 has rearwardly projecting contact pins 3 and 4, to which the coaxial conductor or cable 5 is connected electrically with the aid of a connecting member 6, as explained in more detail herebelow. The connection is configured so that the coaxial conductor 5 is displaced laterally in relation to the pins 3 and 4 in the terminal strip 2. This makes the pins 3 and 4 accessible to a test device 7, illustrated in broken lines in FIG. 2, even when the connecting device 1 is plugged into a corresponding contact device. As shown in FIG. 2, the connecting device 1 is provided with a casing 8, which functions to screen and protect the outwardly projecting pins in the terminal strip and also to lock the connecting device 1 in its plugged-in position in a corresponding contact device. The casing may also be provided with a cable lock (not shown) for locking and protecting the coaxial conductor and the connecting member against mechanical damage.

Figure 3:
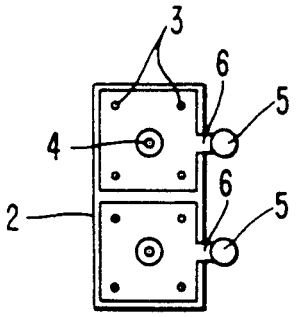
FIG. 3 is a rear view of a duplicate connecting device, i.e. a view from above in FIG. 1.

FIG. 3 shows the inventive connecting device from the rear, i.e. from above in FIG. 1. In this case, the connecting device 1 is duplicated, i.e. intended for two coaxial conductors 5, which are connected to corresponding pins 3 and 4 in the terminal strip 2 via connecting members 6.

Figure 4:
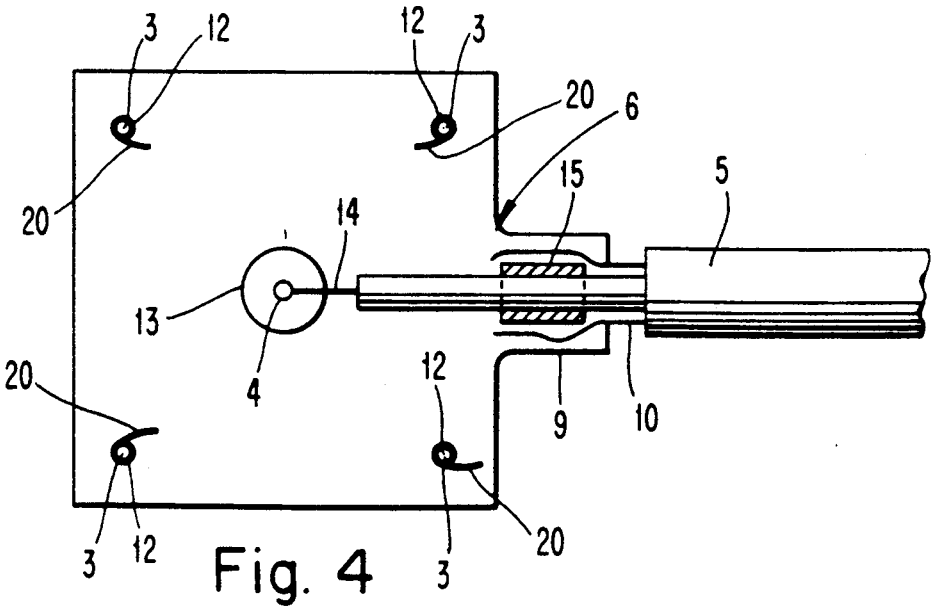
FIG. 4 illustrates in larger scale a number of the components of the connecting device.

The connecting member 6 which functions to connect the coaxial conductor 5 to corresponding pins 3 and 4 will now be described in more detail with reference to FIG. 4. One end of the connecting member 6 has formed thereon a sleeve 9 (which is shown in FIG. 4 as if it were bent sideways in FIG. 4, for greater clarity) which is firmly pressed into electrically-conductive contact with the screen 10 of the coaxial conductor 5, said screen being exposed at the outer end of the coaxial conductor. The other end of the connecting member has the form of a square plate 11 and a hole 12 is punched in each of the four corners of the square. The plate is provided with an opening 13 centrally in relation to the holes 12. The plate 11 is disposed on the terminal strip 2 so that the first pins 3 will pass through corresponding first holes 12. The plate 11 is soldered, or wired by wires 20 (as shown in FIGS. 1 and 4), to the pins 3 and is thus in electrically-conducting contact therewith. The central opening, or second hole, 13 in the plate 11, on the other hand, has dimensions such that the plate 11 will not be in electrically-conducting contact with the corresponding centrally located second pin 4 in the terminal strip, i.e., the second pin 4 will be electrically insulated from the plate 11 by an air gap. The pin 4 is soldered or wired to the central conductor 14 of the coaxial conductor 5.

In order to improve attachment of the connecting member 6 to the coaxial conductor 5, a tube 15 may be placed between the central conductor 14 of the coaxial conductor 6 and the exposed screen 10. The tube 15 is preferably serrated, in order to improve contact between the connecting member 6 and the screen 10 and improve retention at the central conductor 14.

It will be understood that the invention is not restricted to the aforedescribed and illustrated embodiment, and that modifications can be made within the scope of the following claims.

I claim:

1. A connecting device for connection with a coaxial conductor, comprising:

a terminal strip, said terminal strip including a plurality of first pins extending in a first direction, and at least one second pin also extending in said first direction; and a connecting member, said connecting member including a flat plate and a sleeve which is electrically connected to said plate and which is electrically connectable to an outer end of a screen of the coaxial conductor, wherein said plate includes a plurality of first holes through which said plurality of first pins extend and at least one second hole through which said at least one second pin extends such that said plurality of first pins are electrically connected to said plate and said at least one second pin is electrically insulated from said plate, said sleeve extending generally in said first direction spaced from said plurality of first pins and said at least one second pin.

2. A connecting device as claimed in claim 1, wherein said plate is soldered to said plurality of first pins.

3. A connecting device as claimed in claim 1, wherein said plate is wired to said plurality of first pins.

4. A connecting device as claimed in claim 1, wherein said connecting member further comprises a tube disposed within said sleeve for enhancing electrical connection between said sleeve and the screen and for improving retention of a central conductor of the coaxial conductor within said sleeve.

5. A connecting device as claimed in claim 4, wherein said tube serrated.

* * * * *